US011826774B2

(12) United States Patent
Hong

(10) Patent No.: US 11,826,774 B2
(45) **Date of Patent: *Nov. 28, 2023**

(54) CUTTER AND CAULKING GUN

(71) Applicant: SIANG SYUAN FU ENTERPRISE CO., LTD., Changhua County (TW)

(72) Inventor: Han-Lin Hong, Changhua County (TW)

(73) Assignee: SIANG SYUAN FU ENTERPRISE CO., LTD., Changhua County (TW)

( * ) Notice: Subject to any disclaimer, the term of this patent is extended or adjusted under 35 U.S.C. 154(b) by 490 days.

This patent is subject to a terminal disclaimer.

(21) Appl. No.: 17/126,284

(22) Filed: Dec. 18, 2020

(65) Prior Publication Data

US 2022/0193717 A1 Jun. 23, 2022

(51) Int. Cl.
*B05C 17/01* (2006.01)
*B67B 7/46* (2006.01)

(52) U.S. Cl.
CPC ..... *B05C 17/0143* (2013.01); *B67B 7/30* (2013.01)

(58) Field of Classification Search
CPC ..... B05C 17/0143; B67B 7/30
USPC ..... 222/82; 30/289
See application file for complete search history.

(56) References Cited

U.S. PATENT DOCUMENTS 3,105,614 A * 10/1963 Sherbondy ..... B05C 17/0123 222/391
3,130,872 A * 4/1964 Myers ..... B05C 17/015 222/88
3,189,226 A * 6/1965 Sherbondy ..... B05C 17/0143 222/391
4,493,437 A * 1/1985 Breeden ..... B05C 17/0143 222/82
4,802,607 A * 2/1989 Johnson ..... B67B 7/44 222/326
5,815,925 A * 10/1998 Chang ..... B05C 17/01 222/326
5,860,568 A * 1/1999 Mallalieu ..... B67B 7/30 222/326
6,045,005 A * 4/2000 Stratton ..... B67B 7/30 222/391
6,056,156 A * 5/2000 Peng ..... B26D 3/162 222/326
8,904,910 B2 * 12/2014 Marsden ..... B26D 3/169 83/54
11,628,465 B1 * 4/2023 Hong ..... B05C 17/0123 222/80
2005/0023301 A1 * 2/2005 Rumrill ..... B05C 17/01 222/391
2006/0162169 A1 * 7/2006 Whitemiller ..... B26D 3/02 30/182

(Continued)

*Primary Examiner* — Paul R Durand
*Assistant Examiner* — Michael J. Melaragno
(74) *Attorney, Agent, or Firm* — Muncy, Geissler, Olds & Lowe

(57) ABSTRACT

A cutter is configured to be mounted to a push rod of a caulking gun. The push rod includes a pushing portion for pushing a container containing a caulking material and a rear end portion opposite to the pushing portion. The cutter includes: an assembling portion, configured to be mounted at the rear end portion of the push rod; and a cutting portion, connected with the assembling portion and including a cutting member. A caulking gun including the cutter is further provided.

10 Claims, 10 Drawing Sheets

(56) References Cited

U.S. PATENT DOCUMENTS

| | | | | |
|---|---|---|---|---|
| 2006/0163280 | A1* | 7/2006 | Murray | B05C 17/00503 222/81 |
| 2010/0175266 | A1* | 7/2010 | Fischer | B26D 3/169 30/282 |
| 2011/0219630 | A1* | 9/2011 | Johanson | B26B 27/005 30/289 |
| 2013/0160621 | A1* | 6/2013 | Marsden | B05C 17/0123 222/83.5 |

* cited by examiner

CUTTER AND CAULKING GUN

BACKGROUND OF THE INVENTION

Field of the Invention

The present invention relates to a cutter and a caulking gun.

Description of the Prior Art

A cutting member such as utility knife, scissors, or cutter is often used to cut off part of a tubular member. For example, the nozzle of a container containing a caulking material needs to be cut before it can be used.

In the conventional method of using a cutter to cut the tubular member, the tubular member is held by one hand, and the cutter is held by another hand to cut off part of the tubular member. However, it is impossible to hold the caulking gun while holding the cutter at the same time, so that the caulking gun must be not be held in hand before the part of the tubular member is cut off. As a result, it is inconvenient and inefficient to operate the cutting.

The present invention is, therefore, arisen to obviate or at least mitigate the above-mentioned disadvantages.

SUMMARY OF THE INVENTION

The main object of the present invention is to provide a cutter and a caulking gun which facilitates gripping and cutting off a tubular member at the same time. To achieve the above and other objects, the present invention provides a cutter, configured to be mounted to a push rod of a caulking gun, the push rod including a pushing portion for pushing a container containing a caulking material and a rear end portion opposite to the pushing portion, the cutter including: an assembling portion, configured to be mounted at the rear end portion of the push rod; and a cutting portion, connected with the assembling portion and including a cutting member.

To achieve the above and other objects, the present invention further provides a gun body, includes a carrier and a grip portion, the carrier being configured for mounting of a container containing a caulking material; and a push rod, movably mounted to the gun body, the push rod including a pushing portion being movable to within the carrier for pushing the container and arear end portion opposite to the pushing portion, the rear end portion and the carrier being located at two sides of the grip portion; wherein the cutter is disposed at the rear end portion of the push rod. The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
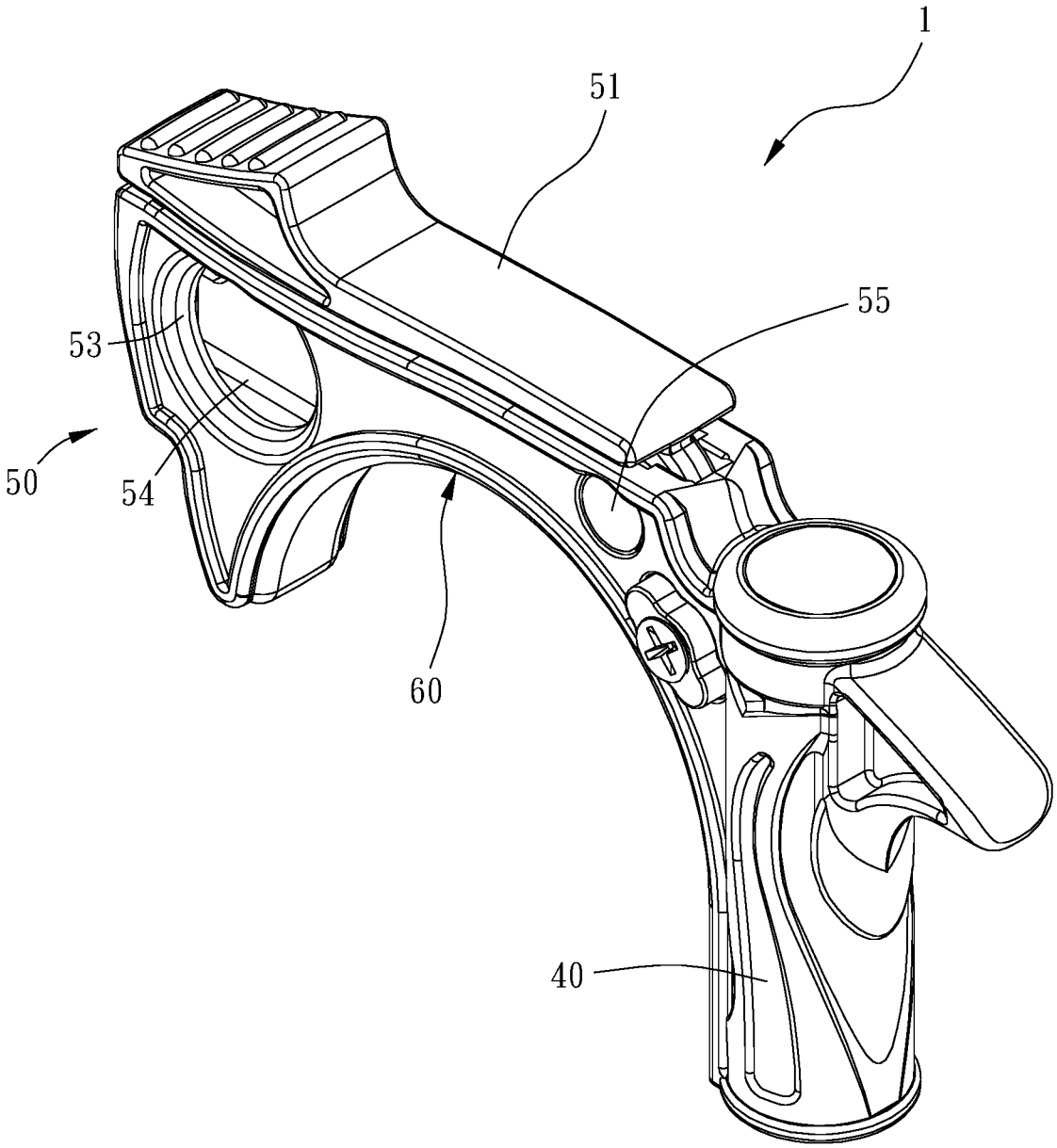
FIG. 1 is a stereogram of a preferable embodiment of the present invention.
Figure 2:
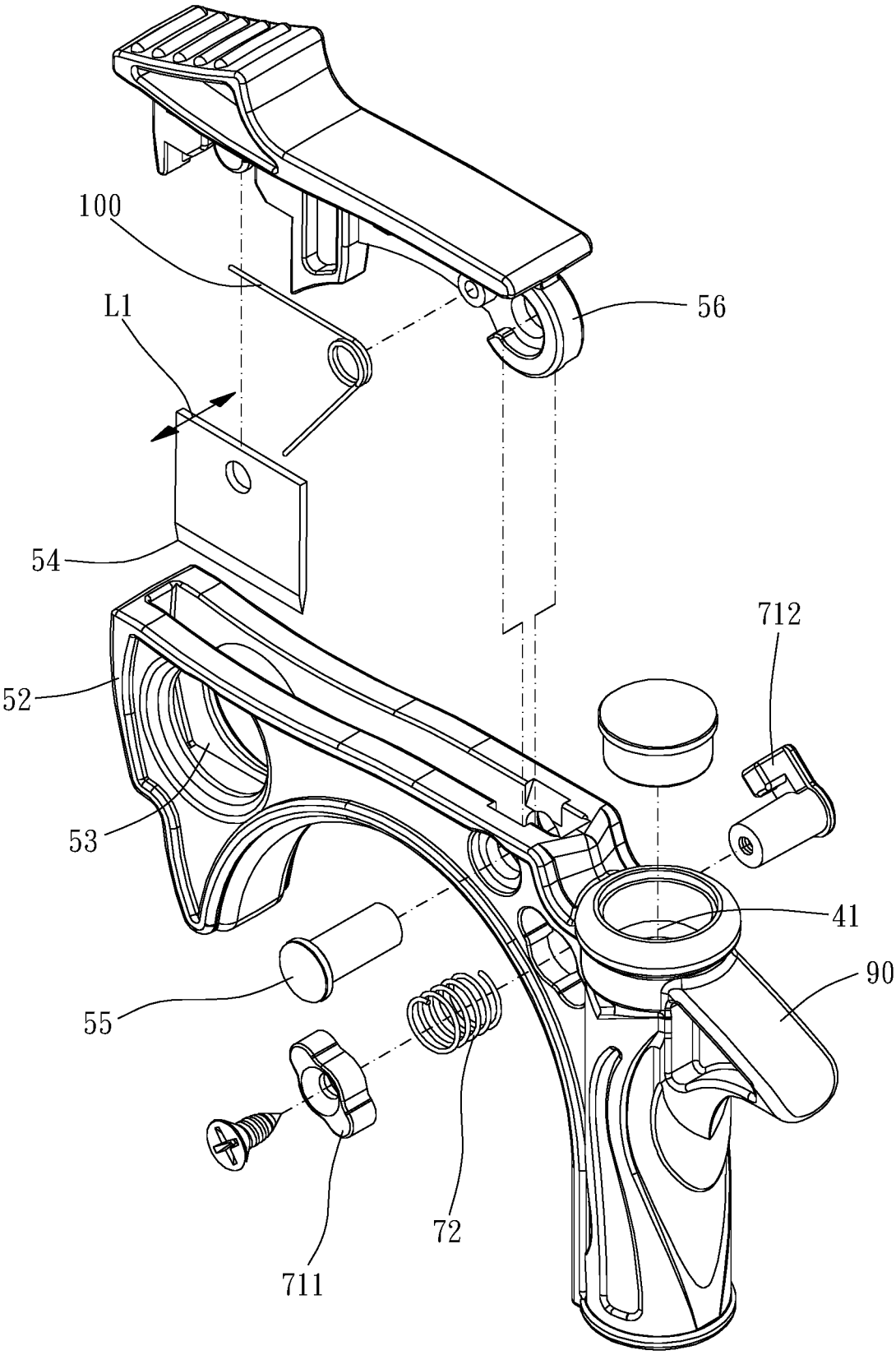
FIG. 2 is a breakdown drawing of a preferable embodiment of the present invention.
Figure 3:
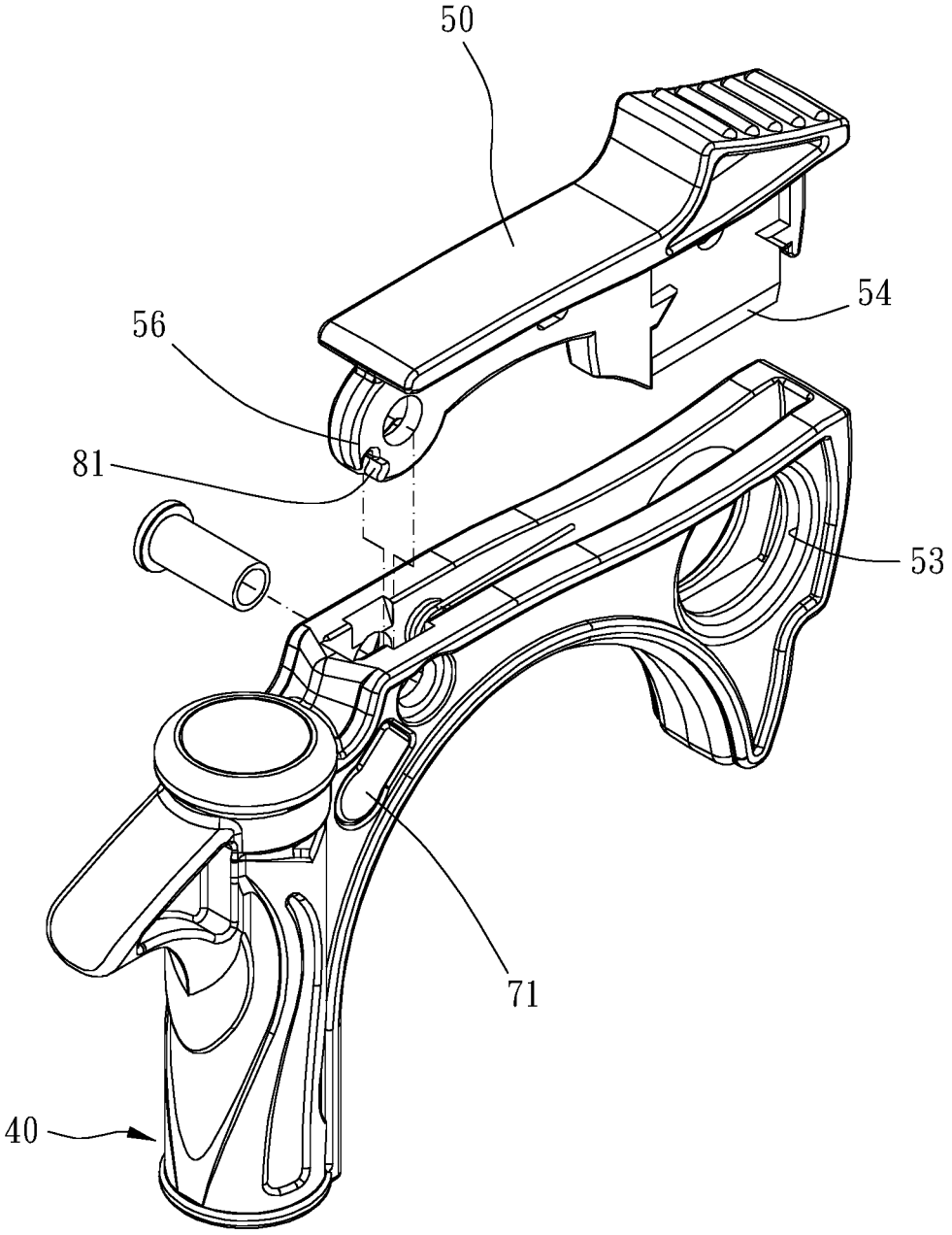
FIG. 3 is another breakdown drawing of a preferable embodiment of the present invention.
Figure 4:
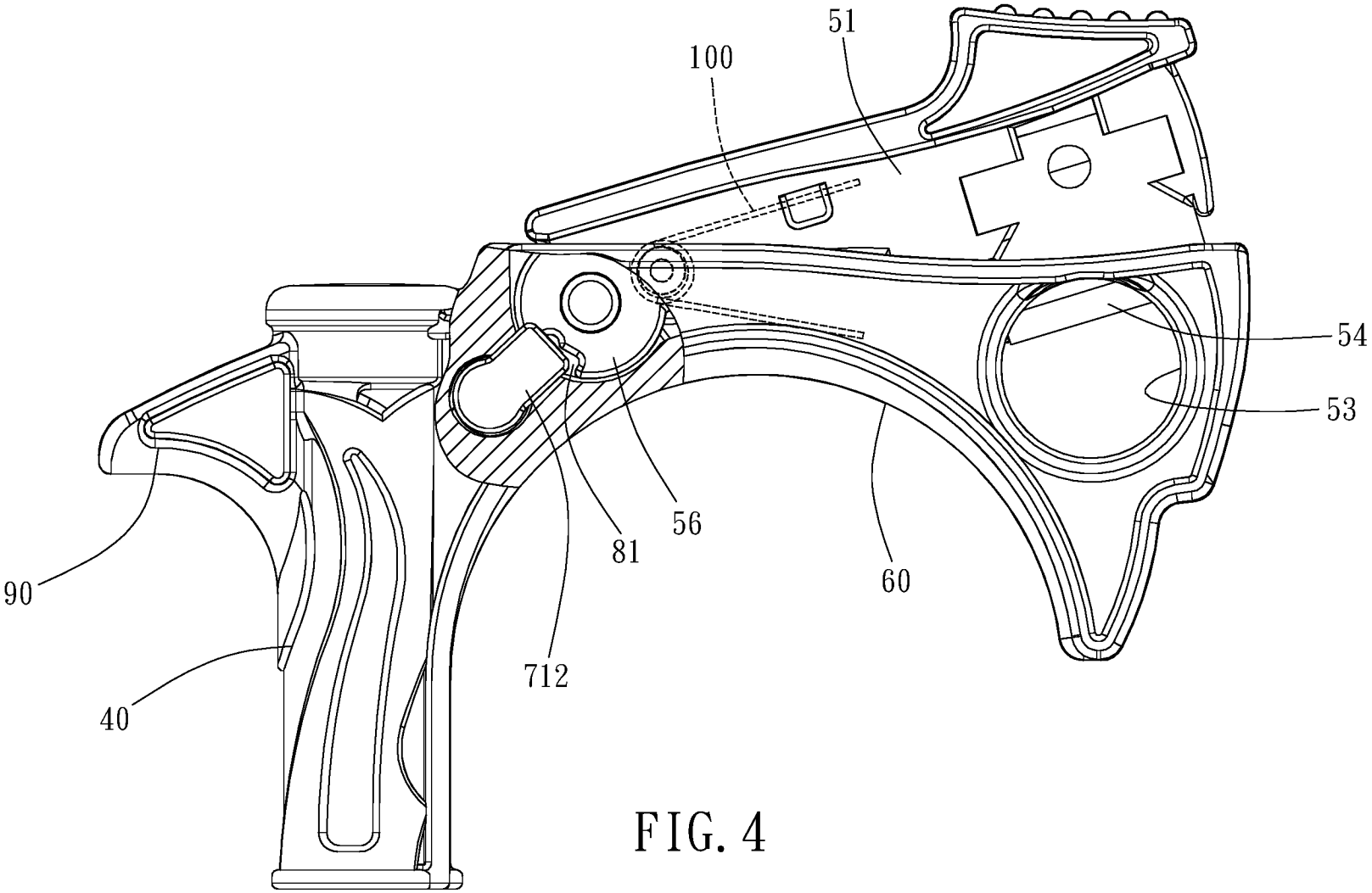
FIG. 4 is a drawing showing a cutting member located in a first position according to a preferable embodiment of the present invention.
Figure 5:
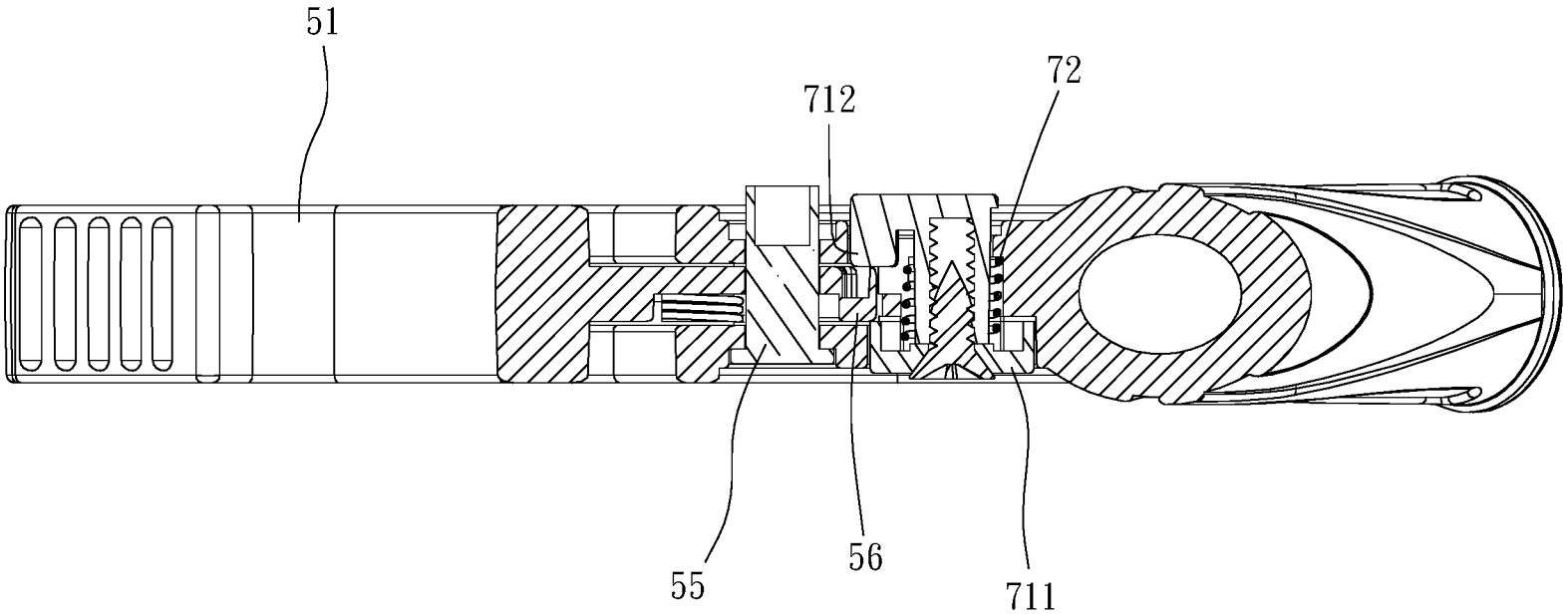
FIG. 5 is a partial cross-sectional view of a cutting member located in a first position according to a preferable embodiment of the present invention.
Figure 6:
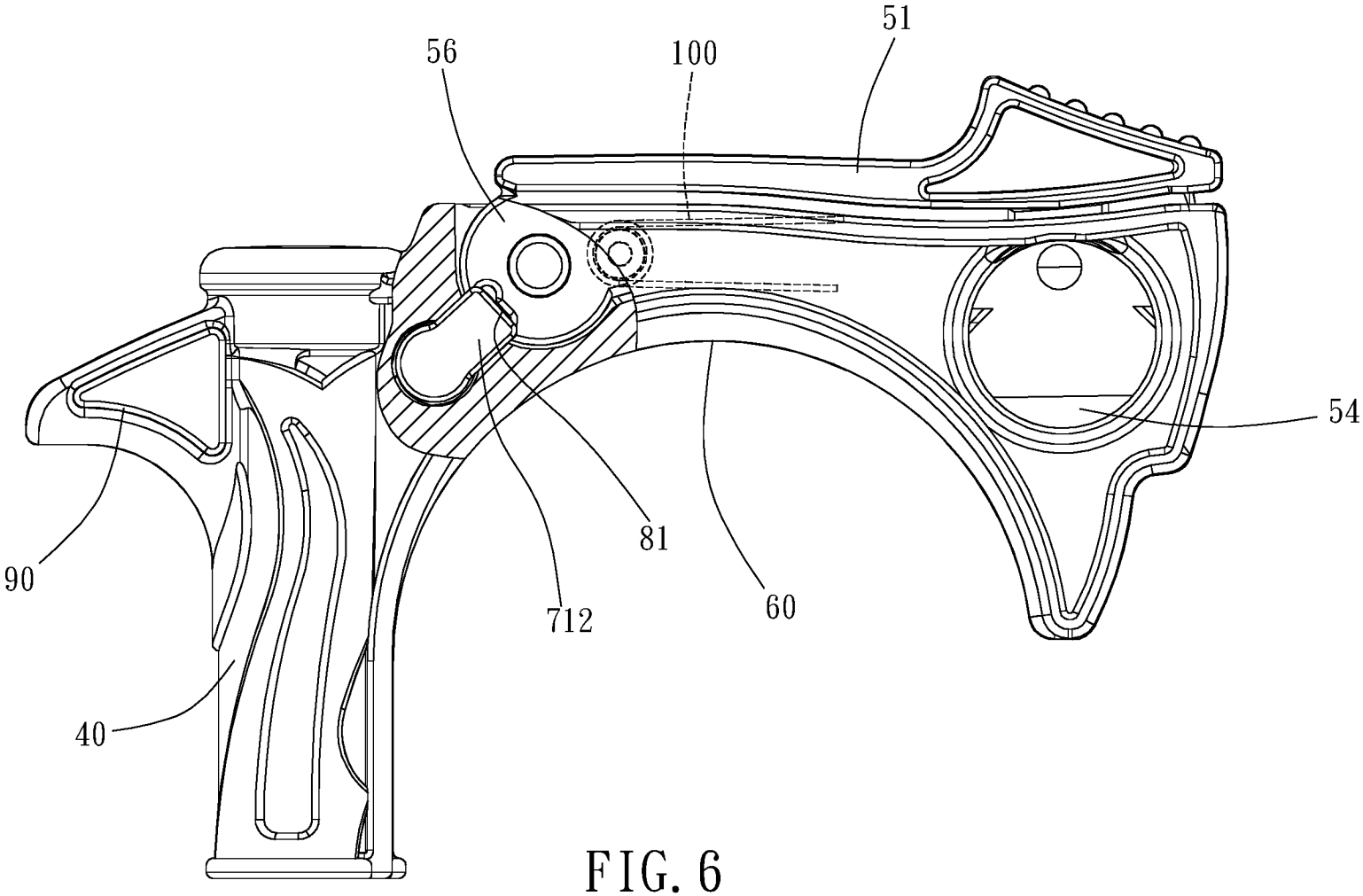
FIG. 6 is a drawing showing a cutting member located in a second position according to a preferable embodiment of the present invention.
Figure 7:
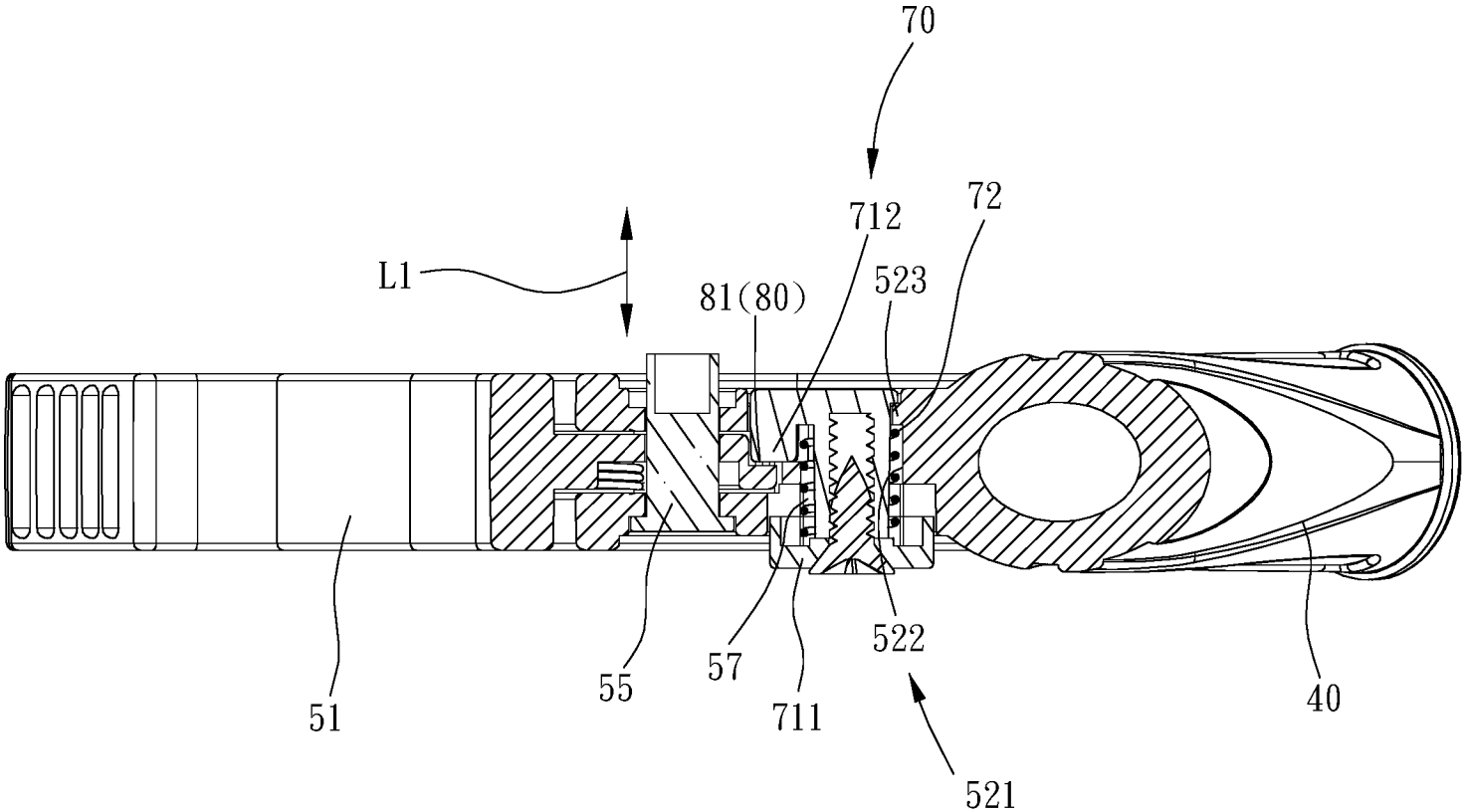
FIG. 7 is a partial cross-sectional view of a cutting member located in a second position according to a preferable embodiment of the present invention.
Figure 8:
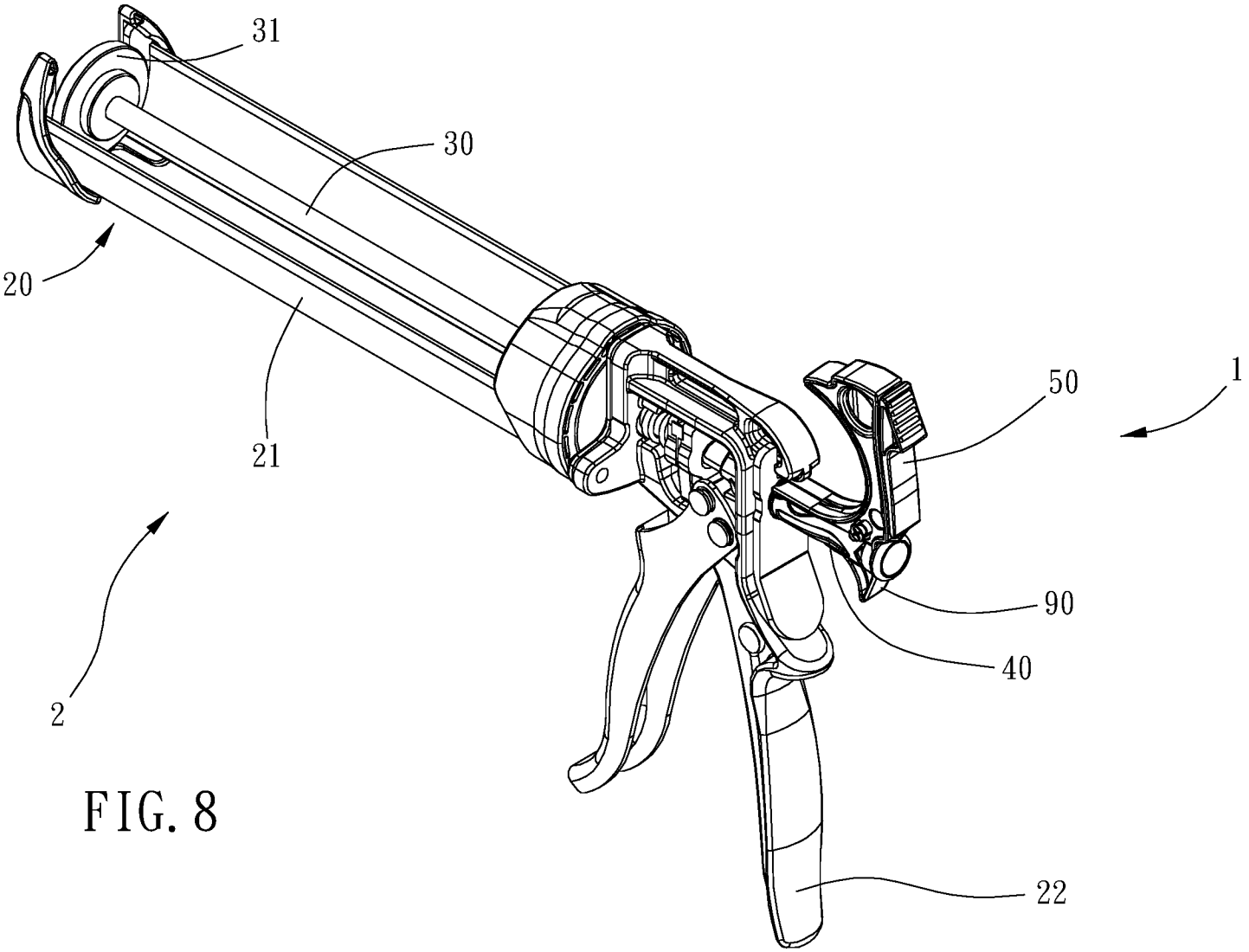
FIG. 8 is a stereogram of a caulking gun having a cutter according to a preferable embodiment of the present invention.
Figure 9:
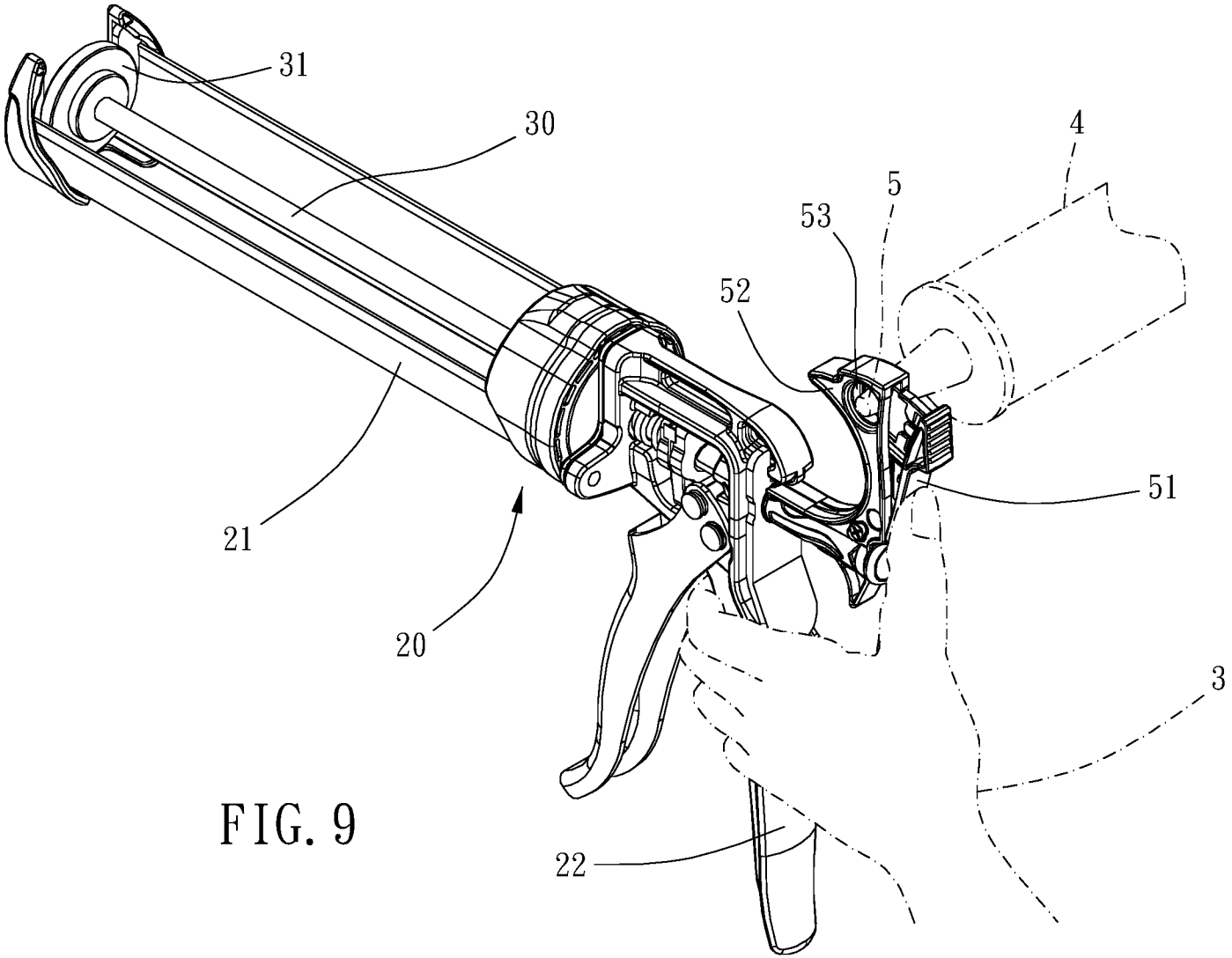
FIG. 9 is a drawing showing operation of a preferable embodiment of the present invention.

Please refer to FIGS. 1 to 10 for a preferable embodiment of the present invention. A cutter 1 of the present invention is configured to be mounted to a push rod 30 of a caulking gun 2, and the push rod 30 includes a pushing portion 31 for pushing a container 4 containing a caulking material and a rear end portion 32 opposite to the pushing portion 31. The cutter 1 includes an assembling portion 40 and a cutting portion 50.

The assembling portion 40 is configured to be mounted at the rear end portion 32 of the push rod 30. The cutting portion 50 is connected with the assembling portion 40, and the cutting portion 50 includes a cutting member 51. Specifically, the assembling portion 40 is detachably disposed at the rear end portion 32 (by urging or screwing, for example). The assembling portion 40 may be fixedly or undetachably disposed at the rear end portion 32 (formed of one piece or fixedly connected, for example). Whereby, while gripping the caulking gun 2, a tubular member (such as a nozzle 5 of the container, or a hose) can be cut off at the same time, and the push rod 30 can be driven by moving the cutter 1.

The cutter 1 further includes a hook portion 60 connected with the assembling portion 40, and the hook portion 60 is configured to be arranged to extend laterally toward the push rod 30. In this embodiment, the hook portion 60 includes a concave face relative to the push rod 30, which facilitates hanging and gripping.

Figure 10:
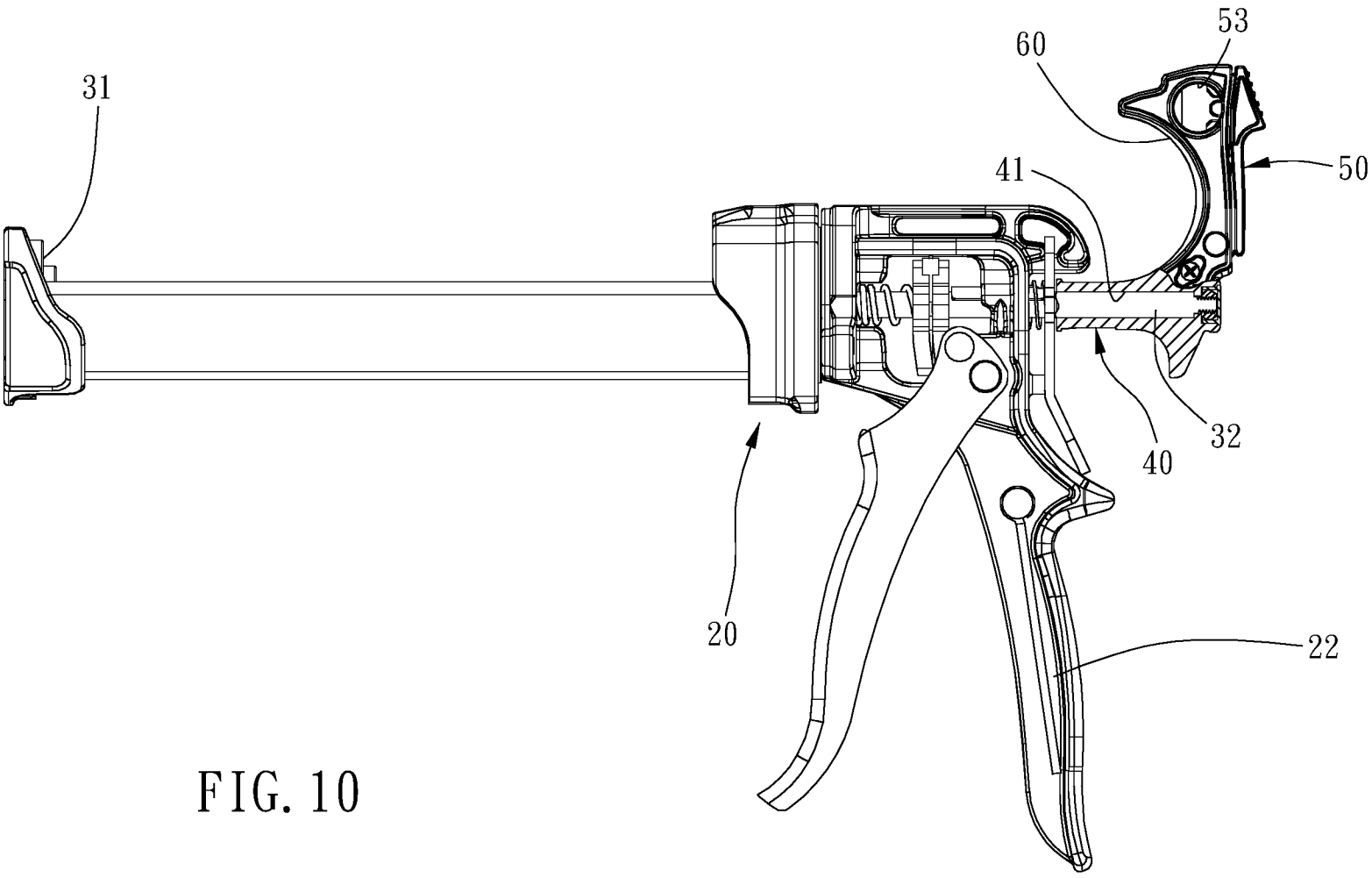
FIG. 10 is a partial cross-sectional view of a caulking gun having a cutter according to a preferable embodiment of the present invention.

The cutting portion 50 further includes a base body 52, the base body 52 includes a through hole 53, the through hole 53 is open in a direction lateral to a longitudinal direction of the push rod 30, the cutting member 51 is movably assembled to the base body 52, the cutting member 51 includes a cutting edge 54 which is movable within the through hole 53, and the hook portion 60 extends from the base body 52. The assembling portion 40 includes a penetrating hole 41 configured to be disposed around the push rod 30, and the base body 52 radially extends from the assembling portion 40. As shown in FIG. 10, in this embodiment, the push rod 30 rear end portion 32 includes a threaded section and is assembled to the assembling portion 40 by a nut screwed to the threaded section.

One of the cutting member 51 and the base body 52 includes a first positioning mechanism 70, and the other of the cutting member 51 and the base body 52 includes a second positioning mechanism 80. The cutting member 51 is movable between a first position (FIG. 4) and a second position (FIG. 6) relative to the base body 52. When the cutting member 51 is located in the second position, the first positioning mechanism 70 and the second positioning mechanism 80 are releasably positioned with each other, and thus the cutting member 51 can be positioned in the second position. The cutting member 51 is stored within the base body 52 in the second position and covers the opening of the base body 52. Specifically, the cutting member 51 is movable on a moving path, the cutting member 51 has a thicknesswise direction L1 lateral to the moving path, the first positioning mechanism 70 includes a blocking member 71 and an elastic member 72, and the blocking member 71 includes an operation portion 711 and a blocking portion 712 disposed at an end of the operation portion 711. The blocking member 71 is movable along the thicknesswise direction L1, the elastic member 72 is abutted between the operation portion 711 and the cutting portion 50, the second positioning mechanism 80 includes a slot 81, and the blocking portion 712 is releasably restricted within the slot 81. The blocking portion 712 can be biased toward the operation portion 711 so as to provide sufficient engagement so that the blocking portion 712 is uneasy to disengage from the slot 81 and engages into the slot 81 automatically. The cutting member 51 is rotatable relative to the base body 52 by a shaft portion 55. The base body 52 includes the first positioning mechanism 70, the cutting member 51 includes a pivoting portion 56, the second positioning mechanism 80 is disposed on the pivoting portion 56, and the slot 81 is disposed on the pivoting portion 56 and extends around a axial direction of the shaft portion 55. The base body 52 includes an insertion portion 521, and the insertion portion 521 includes an insertion hole 57 open in the thicknesswise direction L1, a hole wall 522 defining the insertion hole 57 and a stop portion 523 radially extending inwardly from the hole wall 522. The blocking member 71 is disposed through the insertion hole 57, the elastic member 72 is abutted against the stop portion 523, the cutting member 51 includes the slot 81, the slot 81 is open in the thicknesswise direction L1, and the operation portion 711 is exposed outside the insertion hole 57 in the thicknesswise direction L1. In this embodiment, the operation portion 711 is protrusive beyond the base body 52, for easy operation.

When the cutting member 51 is located in the second position, the cutting edge 54 passes over one half the area of the through hole 53.

The cutter 1 further includes a hanging portion 90 and a resilient member 100 (may be a compression spring or a torsion spring). The hook portion 60 and the hanging portion 90 are located at two sides of the assembling portion 40 radially extend outwardly relative to the penetrating hole 41. The resilient member 100 are abutted between the base body 52 and the cutting member 51, the cutting member 51 can be pressed to swing toward the base body 52 to depress the resilient member 100, and during releasing the resilient member 100 biases the cutting member 51 to recover.

The present invention further provides a caulking gun 2. The caulking gun 2 includes the cutter 1, and the caulking gun 2 further includes a gun body 20 and the push rod 30.

The gun body 20 includes a carrier 21 and a grip portion 22. The carrier 21 is configured for mounting of a container 4 containing a caulking material. The push rod 30 is movably mounted to the gun body 20, and the push rod 30 includes the pushing portion 31 being movable to within the carrier 21 which is provided for pushing the container and the rear end portion 32 opposite to the pushing portion 31. The rear end portion 32 and the carrier 21 are located at two sides of the grip portion 22, and the cutter 1 is disposed at the rear end portion 32 of the push rod 30.

In use, it needs only one hand to grip the grip portion 22, another hand can hold and insert the tubular member (such as a nozzle 5 of the container, or a hose) into the through hole 53, and the cutting member 51 is pressed by the hand 3 to move from the first position to the second position so as to drive the cutting edge 54 to cut off the tubular member. When the cutting member 51 is located in the second position, and the slot 81 corresponds to the blocking portion 712 so that the blocking portion 712 is biased to move into and engage within the slot 81. The hand 3 can directly press the operation portion 711 to drive the blocking portion 712 to disengage from the slot 81 so that the cutting member 51 can recover to be in the first position. During releasing of the operation portion 711, the blocking portion 712 urges the cutting member 51, and the cutting member 51 is biased to move into the slot 81 as the cutting member 51 moves to be in the second position.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A cutter, configured to be mounted to a push rod of a caulking gun, the push rod including a pushing portion for pushing a container containing a caulking material and a rear end portion opposite to the pushing portion, the cutter including:

an assembling portion, configured to be mounted at the rear end portion of the push rod; and a cutting portion, connected with the assembling portion and including a cutting member.

2. The cutter of claim 1, further including a hook portion connected with the assembling portion, wherein the hook portion is configured to be arranged to extend laterally toward the push rod.

3. The cutter of claim 1, wherein the cutting portion further includes a base body, the base body includes a through hole, the cutting member is movably assembled to the base body, the cutting member includes a cutting edge which is movable within the through hole, and the base body includes a hook portion.

4. The cutter of claim 3, wherein the assembling portion includes a penetrating hole configured to be disposed around the push rod, the base body radially extends from the assembling portion, and the hook portion extends outwardly from the base body.

5. The cutter of claim 1, wherein the cutting portion further includes a base body, the base body includes a through hole, the cutting member is movably assembled to the base body, the cutting member includes a cutting edge which is movable within the through hole, one of the cutting member and the base body includes a first positioning mechanism, the other of the cutting member and the base body includes a second positioning mechanism, the cutting member is movable between a first position and a second position relative to the base body, and when the cutting member is located in the second position, the first positioning mechanism and the second positioning mechanism are releasably positioned with each other.

6. The cutter of claim 5, wherein when the cutting member is located in the second position, the cutting edge passes over one half the area of the through hole.

7. The cutter of claim 5, wherein the cutting member is movable on a moving path, the cutting member has a thicknesswise direction lateral to the moving path, the first positioning mechanism includes a blocking member and an elastic member, the blocking member includes an operation portion and a blocking portion disposed at an end of the operation portion, the blocking member is movable along the thicknesswise direction, the elastic member is abutted between the operation portion and the cutting portion, the second positioning mechanism includes a slot, and the blocking portion is releasably restricted within the slot.

8. The cutter of claim 7, wherein the cutting member is rotatable relative to the base body by a shaft portion, the base body includes the first positioning mechanism, the cutting member includes a pivoting portion, the second positioning mechanism is disposed on the pivoting portion, the base body includes an insertion portion, the insertion portion includes an insertion hole open in the thicknesswise direction, a hole wall defining the insertion hole and a stop portion radially extending inwardly from the hole wall, the blocking member is disposed through the insertion hole, the elastic member is abutted against the stop portion, the cutting member includes the slot, the slot is open in the thicknesswise direction, and the operation portion is exposed outside the insertion hole in the thicknesswise direction.

9. The cutter of claim 7, wherein the assembling portion includes a penetrating hole configured to be disposed around the push rod, the base body radially extends from the assembling portion, and the hook portion extends outwardly from the base body; the hook portion includes a concave face relative to the push rod; the cutter further includes a hanging portion and a resilient member, the hook portion and the hanging portion are located at two sides of the assembling portion and radially extend outwardly relative to the penetrating hole; the through hole is open in a direction lateral to a longitudinal direction of the push rod; the resilient member is abutted between the base body and the cutting member; and when the cutting member is located in the second position, the cutting edge passes over one half the area of the through hole.

10. A caulking gun, includes one of the cutter of claim 1, further including:

a gun body, includes a carrier and a grip portion, the carrier being configured for mounting of a container containing a caulking material; and a push rod, movably mounted to the gun body, the push rod including a pushing portion being movable to within the carrier for pushing the container and a rear end portion opposite to the pushing portion, the rear end portion and the carrier being located at two sides of the grip portion;

wherein the cutter is disposed at the rear end portion of the push rod.

* * * * *